US008708371B2

(12) United States Patent
Balun

(10) Patent No.: US 8,708,371 B2
(45) Date of Patent: Apr. 29, 2014

(54) RECONFIGURABLE SNOWBOARD/DOWNHILL SKIS

(71) Applicant: Golden Gate Furniture Co., Pacifica, CA (US)

(72) Inventor: Richard Balun, Pacifica, CA (US)

(73) Assignee: Rodin, Ltd., Stateline, NV (US)

( * ) Notice: Subject to any disclaimer, the term of this patent is extended or adjusted under 35 U.S.C. 154(b) by 0 days.

(21) Appl. No.: 13/751,007

(22) Filed: Jan. 25, 2013

(65) Prior Publication Data

US 2013/0193672 A1 Aug. 1, 2013

Related U.S. Application Data

(60) Provisional application No. 61/591,818, filed on Jan. 27, 2012, provisional application No. 61/681,069, filed on Aug. 8, 2012.

(51) Int. Cl.
*A63C 11/00* (2006.01)

(52) U.S. Cl.
USPC ..... 280/818; 280/14.2; 280/614

(58) Field of Classification Search
USPC ..... 280/603, 607, 608, 609, 626, 629, 280/14.24; 623/14.22, 14.21
See application file for complete search history.

(56) References Cited

U.S. PATENT DOCUMENTS

| | | | | |
|---|---|---|---|---|
| 4,275,904 | A * | 6/1981 | Pedersen | 280/818 |
| 5,551,728 | A * | 9/1996 | Barthel et al. | 280/818 |
| 5,649,722 | A * | 7/1997 | Champlin | 280/818 |
| 5,984,324 | A * | 11/1999 | Wariakois | 280/14.24 |
| 6,523,851 | B1 * | 2/2003 | Maravetz | 280/603 |

* cited by examiner

*Primary Examiner* — John Walters
*Assistant Examiner* — James Triggs
(74) *Attorney, Agent, or Firm* — Novak Druce Connolly Bove + Quigg LLP

(57) ABSTRACT

Combination ski-snowboard devices reversibly configured in both: a ski configuration comprising two skis each with both an inside and outside edge and a ski binding mounting systems, and in a snowboard configuration having two outside edges and two binding mounting systems. Methods for converting ski-snowboard devices from a snowboard configuration to a ski configuration and from a ski configuration to a snowboard configuration.

20 Claims, 9 Drawing Sheets

RECONFIGURABLE SNOWBOARD/DOWNHILL SKIS

RELATED APPLICATIONS

This application claims the benefit of the filing date of U.S. provisional patent application Ser. No. 61/591,818, filed Jan. 27, 2012, entitled "Alpine Splitboard and U.S. provisional patent application Ser. No. 61/681,069, filed Aug. 8, 2012, entitled "Alpine Split Board," both of which are incorporated by reference herein in their entireties.

BACKGROUND

1. Technical Field

The present disclosure relates to snow-sport equipment and more specifically to a combination snowboard and downhill ski.

2. Introduction

A wide variety of riding products exist for mountain snow sport enthusiasts. Downhill skiing has a long history of innovation and a great variety of ski designs have been developed over the years. Generally downhill skis are substantially flat axial planks with a binding used to couple with a ski boot. Each axial side of the individual skis has a sharpened metal edge that gives the skier the ability to turn and control his speed during downhill descent. Oftentimes the axial side of the individual skis have a parabolic sidecut, meaning the tip and tail of the ski are wider then the middle of the axial distance. The parabolic shape gives the skier more control over turning because the sidecut naturally encourages parabolic motion downhill as a skier applies pressure to the given edge.

Like downhill ski technology, there are many solutions for cross-country skiing and backcountry/alpine trekking. One common design feature for cross-country skiing and backcountry/alpine trekking skis include a binding that holds the toe of the boot securely in place while allowing the heel of the boot to rise and fall in a rhythmic motion. The rhythmic motion facilitates gliding as opposed to a marching motion that is used when snowshoeing.

More recently, snowboarding has enjoyed huge popularity and snowboard design has progressed steadily. Like downhill skis, snowboards are typically designed with substantially parabolic edges to facilitate turning. For functional and safety reasons, snowboards also typically employ bindings that semi-permanently hold the snowboarders boot to the board, forcing the rider to strap in and strap out of the bindings one or two feet when a rider wants to traverse flat or upward portions of the mountain or trail Likewise, unstrapping one foot from a snowboard and "skating" eliminates the advantage of having a large surface area under a rider's feet, causing the rider's feet to sink into the snow and requiring more effort.

In addition to skis and snowboards for use in specific skiing/riding styles, splitboards, which allow use of a single device for more than one ski/ride style, have gained a somewhat recent popularity. A splitboard is a reconfigurable snowboard/alpine-trekking ski combination designed with various clasps and multi-purpose binding configurations to allow a user to physically split a snowboard down its length into two skis, reconfigure the bindings, and use the skis for cross country skiing or backcountry trekking. However, splitboards do not have inside edges suitable for downhill skiing. Due to the lack of edges and a function-limiting straight inside edge, splitboard skis are unusable for downhill skiing.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are various embodiments of a combination ski-snowboard device interchangeably configured in one of: a ski configuration comprising two skis each with both an inside and outside edge and a ski binding mounting systems, and in a snowboard configuration having two outside edges and two binding mounting systems.

Some embodiments involve a ski-snowboard combination device involving a first gliding board having and first edge having a substantially concave shape, a second gliding board having a first edge having a substantially concave shape, and a fastening device configured to reversibly affix the inside edge of the first gliding board to the inside edge of the second gliding board, thereby forming an opening with two convex sides.

In some embodiments, the ski-snowboard combination device comprises a ski binding mounting system coupled with each of the gliding boards and one half of a snowboard binding system, thereby allowing the ski-snowboard to be converted between ski and snowboard configurations.

In some embodiments, the ski binding mounting systems involve a bottom plate coupled with a gliding board, an aperture in the bottom plate, and a top plate having a disk disposed on the bottom-side surface of the top plate. The disk releasably couples with the aperture of the bottom plate and releases in the event of a threshold level of torque applied to the disk and a topside surface of the top plate is configured with a boot. In some embodiments, the bottom plate includes a torque-sensitive release mechanism, a set screw accessible from the outside of the bottom plate in mechanical communication with the torque-sensitive release mechanism and configured for adjusting the threshold torque, an release setting gauge visible from the outside of the bottom plate for displaying a quantified representation of the threshold torque.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Disclosed is a gliding board that is adapted to split apart to become a pair of downhill skis and further adapted to come together to become a snowboard and which supports boots in both the skier position as well as the snowboarder's position. Some embodiments of the combination snowboard/skis include especially designed connection hardware that facilitates switching between snowboarding mode and skiing mode. Additionally, some embodiments include binding configurations designed to allow snowboarding mode, downhill skiing mode, cross-country skiing, and telemark skiing.

Figure 1A:
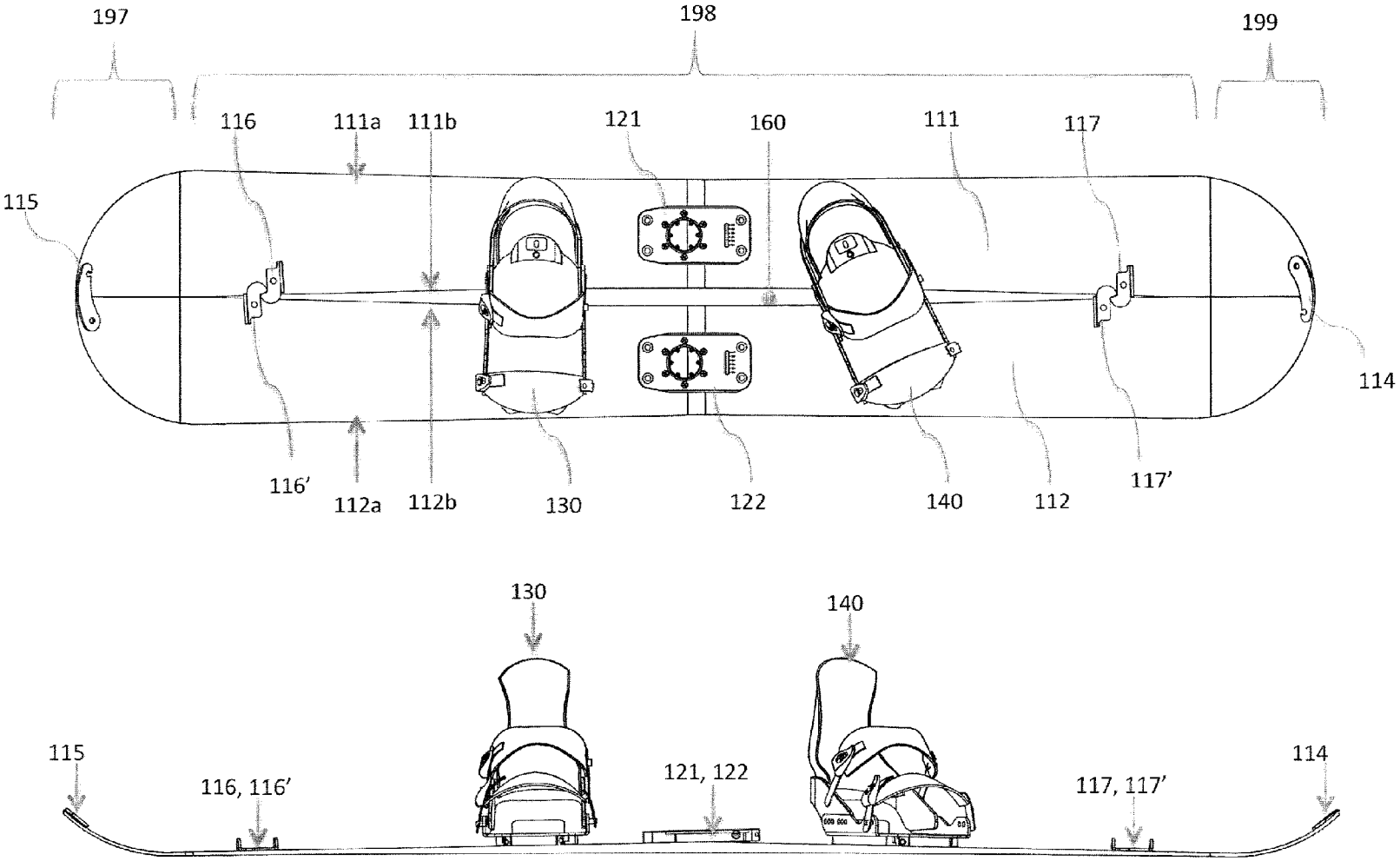
FIG. 1A illustrates isometric top and side views of a combination snowboard/skis in a snowboard configuration according to some embodiments of the present technology.

FIG. 1A illustrates isometric top and side views of a combination snowboard/skis in a snowboard configuration according to some embodiments of the present technology. The combination snowboard/skis comprises three zones: a tip zone 199, a tail zone 197, and a central zone 198. In some embodiments, at least the tip zone 199 is curved up. In some embodiments, both the tip zone 199 and the tail zone 197 are curved upwards. The combination snowboard/skis comprises two gliding boards 111, 112 coupled together with a tip connector 114, a tail connector 115, and two ski connection clip pairings 116, 116' and 117, 117'. According to FIG. 1A, a set of bindings 130, 140 are coupled with the combination snowboard/skis via a snowboard binding system (not shown), explained below. Additionally, the individual gliding boards 111, 112 each include a ski binding plate system 121, 122 for coupling with the bindings 130, 140.

The individual gliding boards 111, 112 each include two sharpened metal edges 111*a*, 111*b*, 112*a*, 112*b*. In some embodiments, all of the edges 111*a*, 111*b*, 112*a*, 112*b* comprise a substantially parabolic shape. In the snowboard configuration, edges 111*a* and 112*a* comprise the snowboard's outer edge configured to facilitate turning the snowboard. Also, the edges 111*b* and 112*b* form a small channel 160. In some embodiments, an insert (not shown) is configured to fill the channel 160 and couple with the gliding boards 111, 112. In some other embodiments, the one or both of the gliding boards 111, 112 are configured with a movable flange (not shown) to fill the channel 160.

Figure 1B:
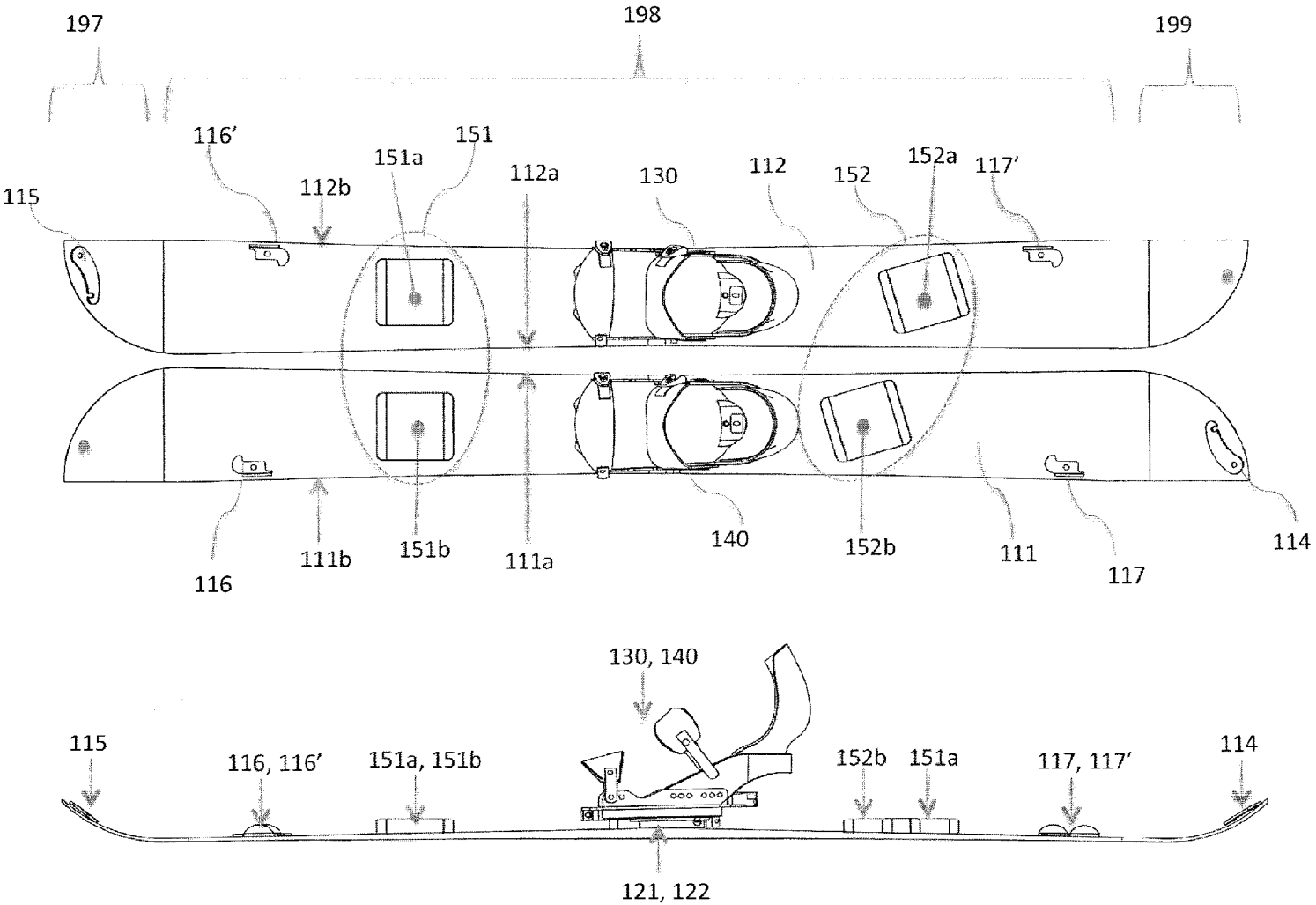
FIG. 1B illustrates isometric top and side views of the combination snowboard/skis from FIG. 1A in a ski configuration according to some embodiments of the present technology.

FIG. 1B illustrates isometric top and side views of the combination snowboard/skis from FIG. 1A in a ski configuration according to some embodiments of the present technology. The ski configuration illustrated in FIG. 1B involves the position of the gliding boards 111, 112 swapped such that the curved portions of the tip zone 199 and the tail zone 197 are positioned on the inside edge of a skier's stance. In some other embodiments, the gliding boards 111, 112 are positioned such that the curved portions of the tip zone 199 and the tail zone 197 are positioned on the outside edge of a skier's stance.

In the snowboard configuration, the set of bindings 130, 140 were coupled with the combination snowboard/skis via a snowboard binding system comprising two snowboard binding plate systems 151, 152.

The snowboard binding plate systems 151, 152 are each configured with a sub-plate positioned substantially across from another sub-plate on each gliding board 111, 112, respectively. As shown, the snowboard binding plate systems 151 comprise sub-plates 151*a* and 151*b*; likewise, the snowboard binding plate system 152 comprises sub-plates 152*a* and 152*b*. In some embodiments of the present technology, the position of the sub-plates 151*a*, 151*b*, 152*a*, and 152*b* are reconfigurable to allow individual riders to customize their binding positions. For example, in some embodiments, a series of drill holes (not shown) are drilled into the gliding boards 111, 112 and the sub-plates 151*a*, 151*b*, 152*a*, 152*b* coupled with the gliding boards 111, 112 via the drill holes in a plurality of combinations and arrangements. In some other embodiments, the sub-plates 151*a*, 151*b*, 152*a*, 152*b* are in a substantially fixed position and the rider tailors the riding position using a puck system in the sub-plates 151*a*, 151*b*, 152*a*, 152*b* or in the bindings themselves. Additionally, some embodiments of the present technology involve binding plate systems that are configured such that the binding system separates in the event of a threshold level of torque being applied, thereby causing the skier's/rider's feet to come free from the board(s) in circumstances that could cause injury to the rider.

In the ski configuration, the set of bindings 130, 140 are coupled with the combination snowboard/skis via the ski binding plate systems 121, 122.

Figure 2:
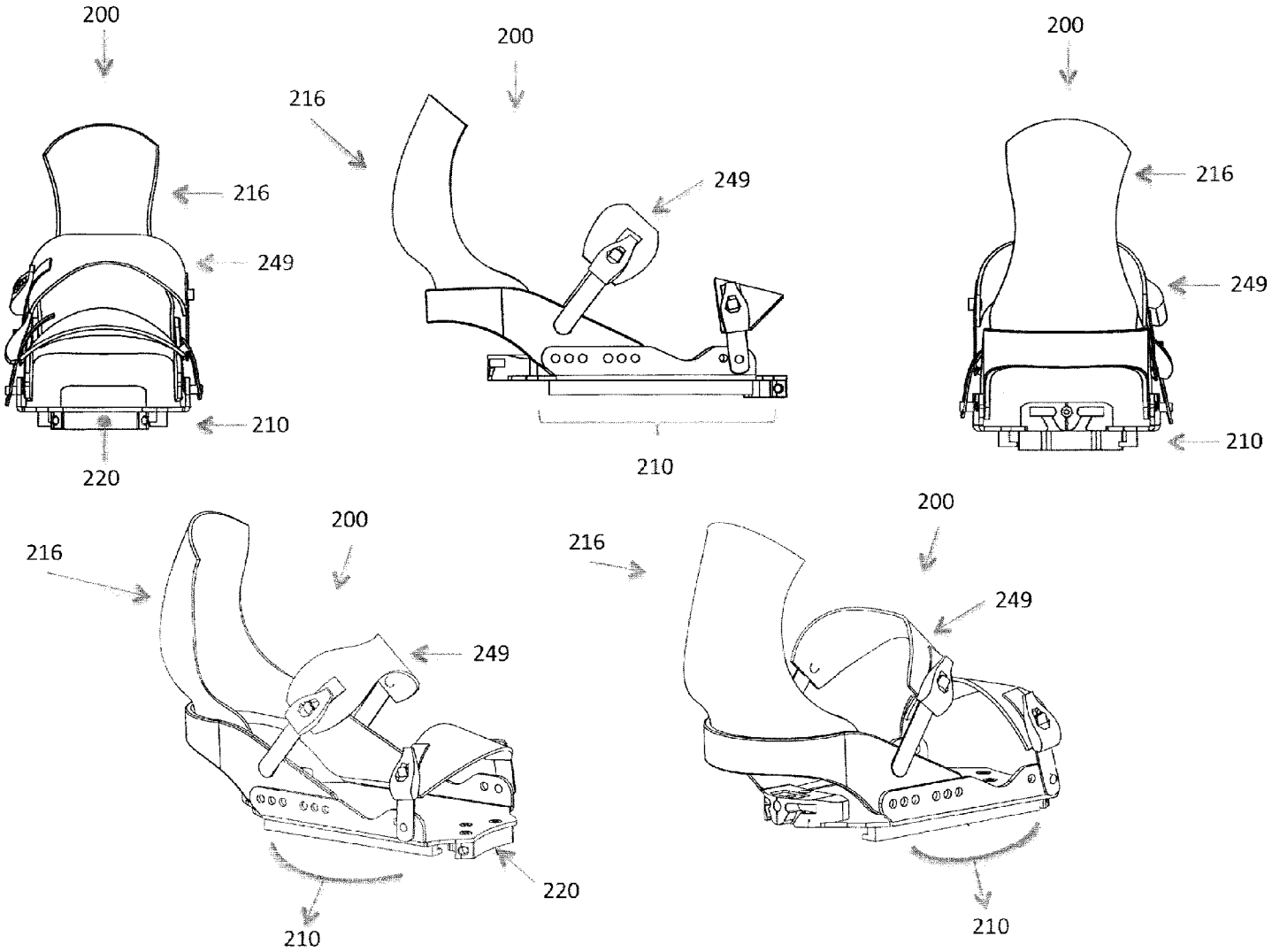
FIG. 2 illustrates various isometric views of an exemplary binding for coupling with a combination snowboard/skis according to some embodiments of the present technology.

FIG. 2 illustrates various isometric views of an exemplary binding 200 for coupling with a combination snowboard/skis according to some embodiments of the present technology. As shown, the binding 200 includes a slider track 210 configured to slide over the ski binding plate systems (e.g. FIGS. 1A-1B, reference nos. 121, 122) in the ski position and configured to slide over the sub-plates (e.g. FIG. 1B, reference nos. 151*a* and 151*b*, 152*a* and 152*b*) in the snowboard position. The toe edge of the binding 200 includes a stopper plate 220 to prevent the binding 200 from sliding off the slider tracks 210 in one direction of sliding motion. To prevent the binding 200 from sliding off the slider tracks 210 in the reverse direction of sliding motion, the binding 200 configured to accept a locking slide pin (not shown).

In some embodiments of the present technology, the binding 200 is configured with a lockable calf back 216. The lockable calf back 216 can fold down for convenience and can lock in a rigid upright configuration. Additionally, the binding 200 can include a reconfigurable top strap 249 that can be positioned in a mid-ankle position (as shown) to hold a rider's boot in an ankle-flexing snowboard stance and positioned on the calf back 216 to hold a skier's boot in a high-ankle rigid ski stance.

As explained above, the combination snowboard/skis illustrated in FIGS. 1A-1B have a tip zone 199 and a tail zone 197 which, when in the snowboard configuration, are joined to form a complete semi-circular shape that is typically associated with a snowboard. In ski embodiments of the present technology, the combination snowboard/skis are configured such that the tip zone and the tail zone which, when in the ski configuration, comprise two individual half-semi-circular ski tips.

Figure 3A:
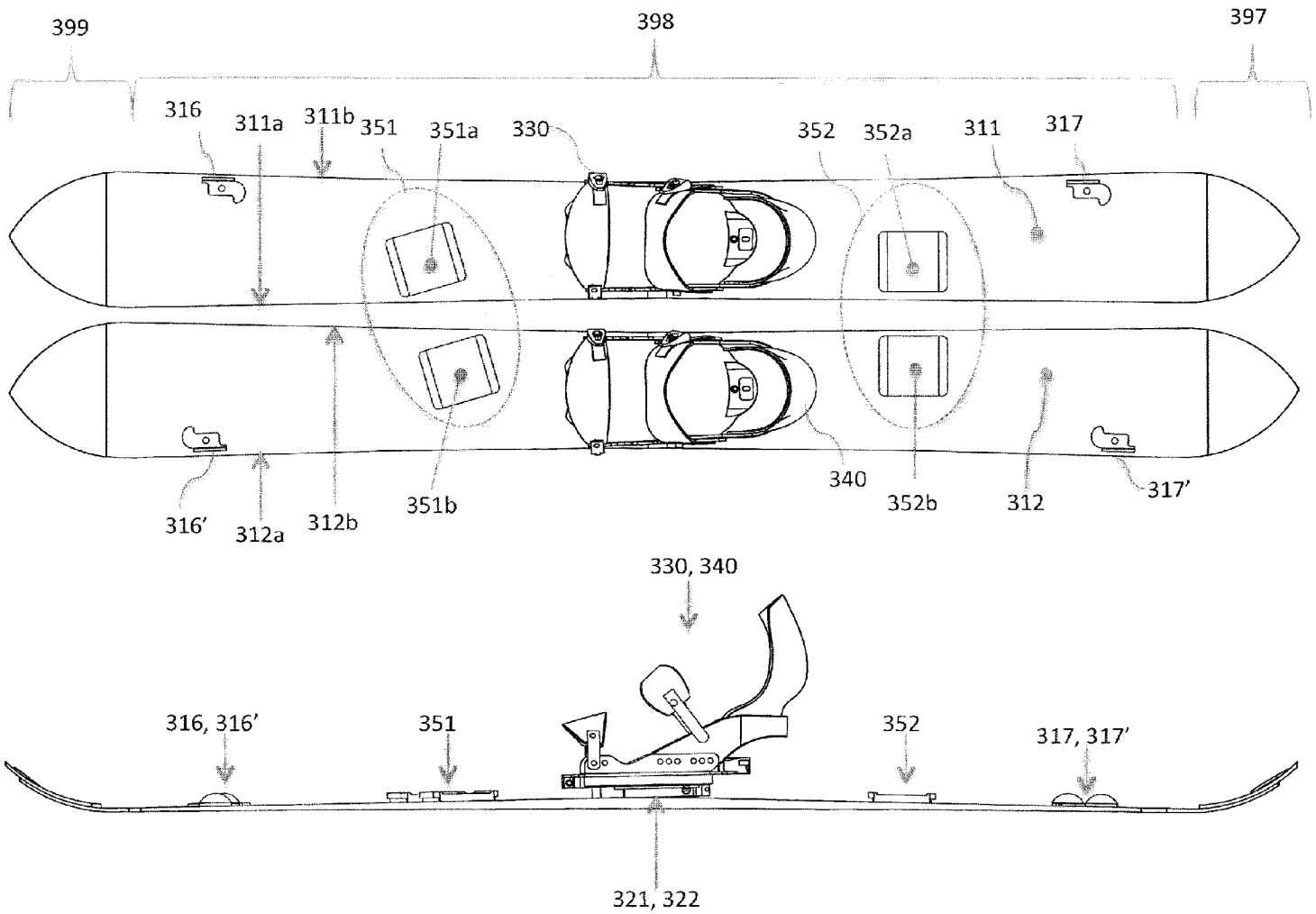
FIG. 3A illustrates isometric top and side views of a combination snowboard/skis in a ski configuration according to some embodiments of the present technology.

FIG. 3A illustrates isometric top and side views of a combination snowboard/skis in a ski configuration according to some embodiments of the present technology. The combination snowboard/skis comprises two gliding boards 311, 312. The combination snowboard/skis comprises three zones: a tip zone 399, a tail zone 397, and a central zone 398. As shown, the tip zone 399 and the tail zone 397 of each gliding board 311, 312 comprise two individual semi-circular ski tips typically associated with skis. In some embodiments, at least the tip zone 399 is curved up. In some embodiments, both the tip zone 399 and the tail zone 397 are curved up.

Gliding board 311 is configured with clips 316, 317 and gliding board 312 is configured with clips 316', 317', where clips 316, 316' and clips 317, 317' are configured to connect the gliding boards 311, 312 when in the snowboard configuration (illustrated below.)

As shown in FIG. 3A, a set of bindings 330, 340 are coupled with the gliding boards 311, 312 via ski binding plate systems 321, 322. Additionally, the combination snowboard/skis include two snowboard binding plate systems 351, 352. The snowboard binding plate systems 351, 352 are each configured with a sub-plate positioned substantially across from another sub-plate on each gliding board 311, 312. As shown, the snowboard binding plate system 351 comprises sub-plates 351*a* and 351*b*; likewise, the snowboard binding plate system 352 comprises sub-plates 352*a* and 352*b*. In some embodiments of the present technology, the position of the sub-plates 351*a*, 351*b*, 352*a*, and 352*b* are reconfigurable to allow individual riders to customize their binding positions. For example, in some embodiments, a series of drill hole (not shown) are drilled into the gliding boards 311, 312 and the sub-plates 351*a*, 351*b*, 352*a*, 352*b* coupled with the gliding boards 311, 312 via the drill holes in a plurality of combinations and arrangements. In some other embodiments, the sub-plates 351*a*, 351*b*, 352*a*, 352*b* are in a substantially fixed position and the rider tailors the riding position using a puck system in the sub-plates 351*a*, 351*b*, 352*a*, 352*b* or in the bindings themselves.

The individual gliding boards 311, 312 each include two sharpened metal edges 311*a* and 311*b*, 312*a* and 312*b*, respectively. In some embodiments, all of the edges 311*a*, 311*b*, 312*a*, 312*b* comprise a substantially parabolic shape.

Figure 3B:
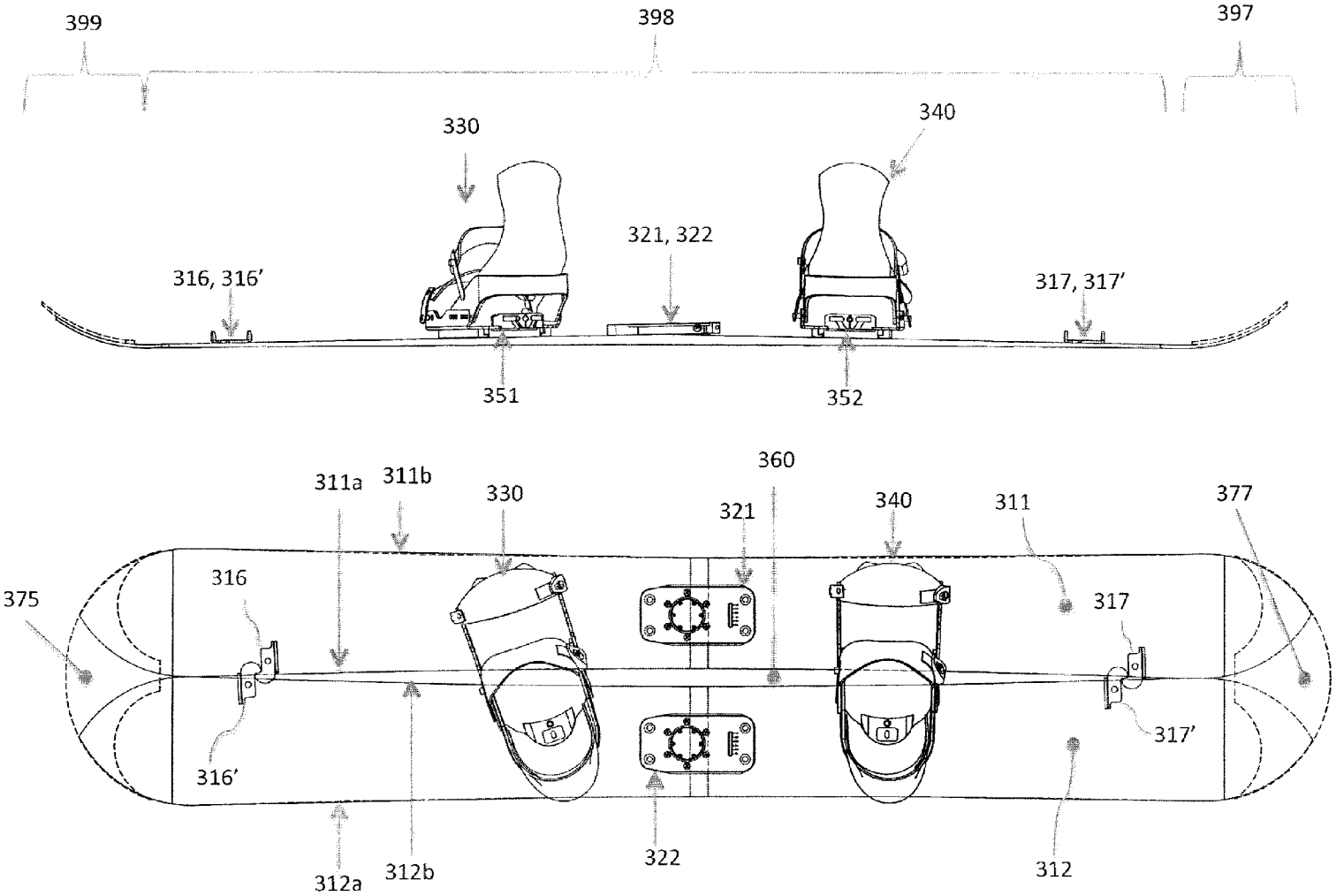
FIG. 3B illustrates isometric top and side views of the combination snowboard/skis from FIG. 3A in a snowboard configuration according to some embodiments of the present technology.

FIG. 3B illustrates isometric top and side views of the combination snowboard/skis from FIG. 3A in a snowboard configuration according to some embodiments of the present technology. In the ski configuration, the set of bindings 330, 340 were coupled with the gliding boards 311, 312 via ski binding plate systems 321, 322. According to FIG. 3B, the set of bindings 330, 340 are coupled with the gliding boards via the plate systems 351, 352. In the snowboard configuration, edges 311*a* and 312*a* comprise the snowboard's outer edge configured to facilitate turning the snowboard. Also, the edges 311*b* and 312*b* form a small channel 360.

The gliding boards 311, 312 are coupled in the snowboard configuration with clips 316, 317, 316', and 317'. In some embodiments of the present technology, the tips and tails of the gliding boards 311, 312 are also coupled with each other with a jacket, clip, etc. As shown in FIG. 3, the tips and tails of the gliding boards 311, 312 are coupled via structural, semi-circular jackets 375, 377. The jackets 375, 377 fit over the tip 399 and the tail zone 397 of the gliding boards 311, 312 as well as forming tips and tails with a full semi-circular shape typically associated with snowboards. In some embodiments, the jackets 375, 377 are configured to be partially separated from the tips and tails of the gliding boards 311, 312 and to be folded over and clipped to one or both of the gliding boards 311, 312. In some other embodiments, the jackets 375, 377 are configured to be completely separated from the tips and tails of the gliding boards 311, 312.

Figure 4A:
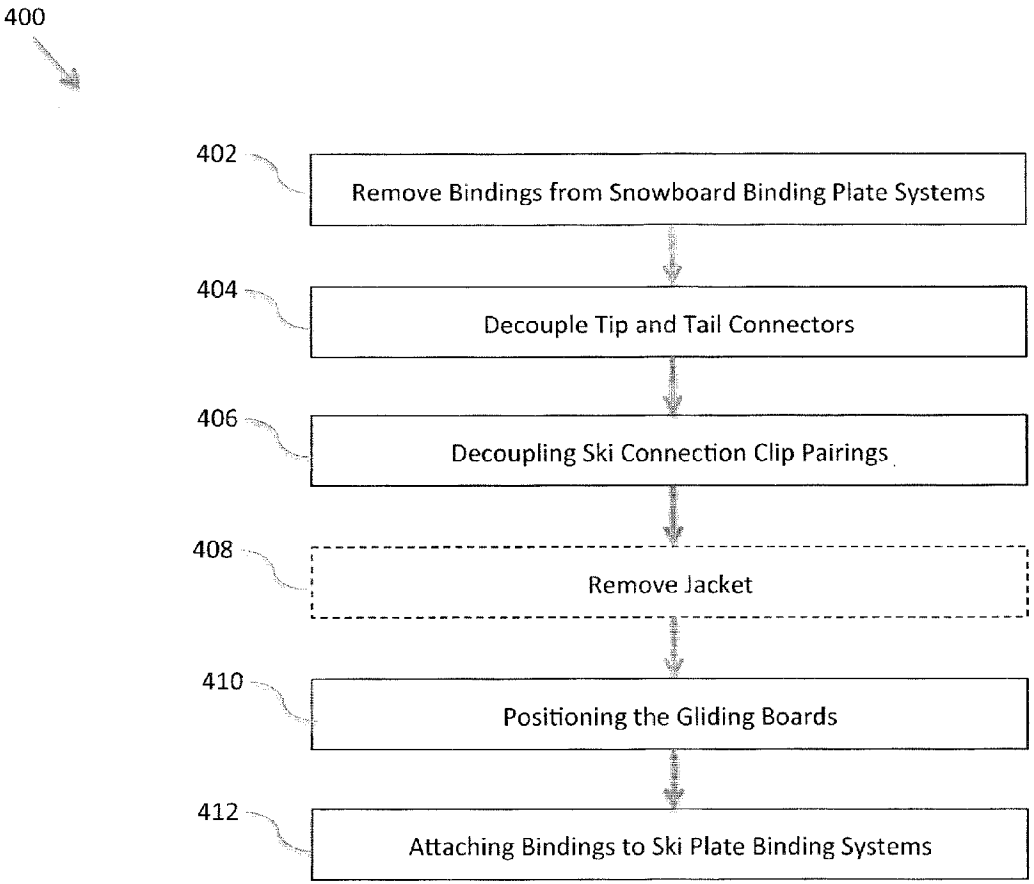
FIG. 4A illustrates a method of converting combination snowboard/skis from a snowboard configuration to a ski configuration according to some embodiments of the present technology.

FIG. 4A illustrates a method 400 of converting combination snowboard/skis from a snowboard configuration to a ski configuration according to some embodiments of the present technology. The method 400 begins with removing the bindings from the snowboard binding plate systems 402, decoupling the tip connector and tail connector 404, and decoupling the ski connection clip pairings 406. In cases using a structural semi-circular jacket, the method 400 involves removing and storing the jacket 408.

Next, the method 400 involves positioning the skis in a proper downhill configuration 410. For example, some embodiments involve swapping the position of the gliding boards relative to the axial length of the boards such that the curved portion of the tips and tails are positioned on the inside edge of the skier's stance, see FIG. 1B. Next, the method 400 involves attaching the bindings to ski binding plate systems 412.

Figure 4B:
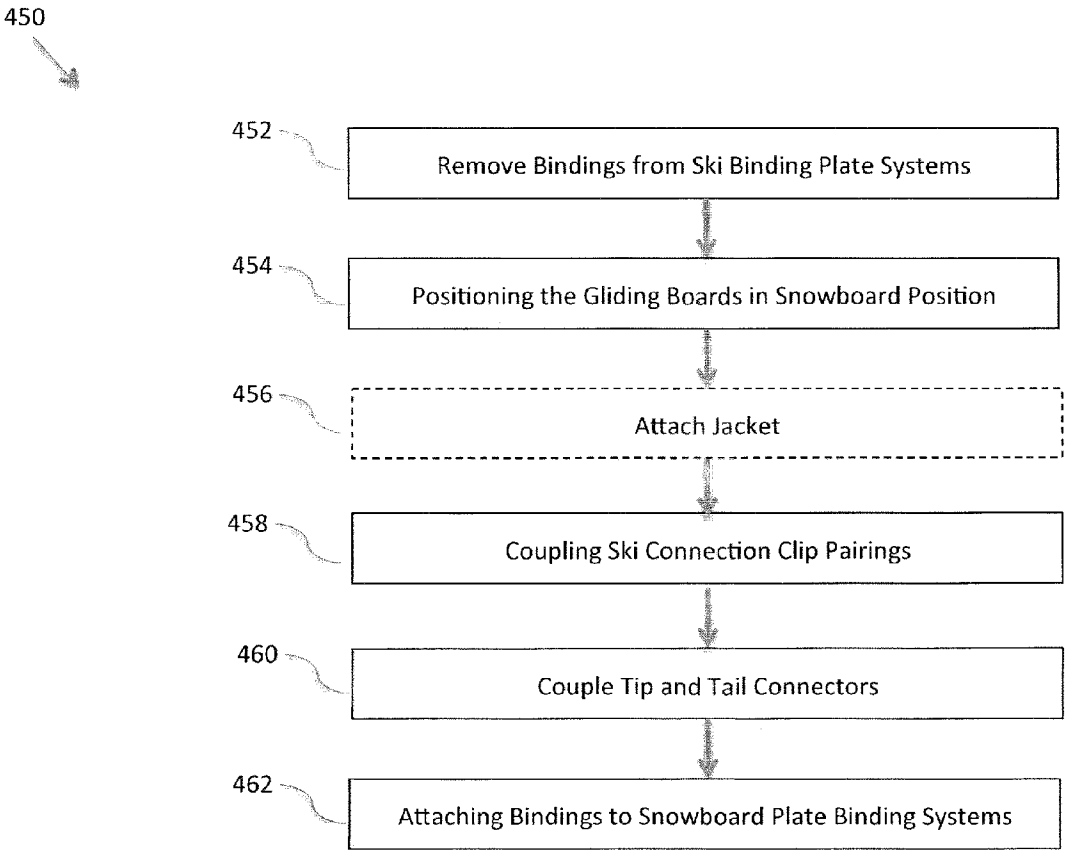
FIG. 4B illustrates a method of converting combination snowboard/skis from a ski configuration to a snowboarding configuration according to some embodiments of the present technology.

FIG. 4B illustrates a method 450 of converting combination snowboard/skis from a ski configuration to a snowboarding configuration according to some embodiments of the present technology.

The method 450 begins with removing the bindings from the ski binding plate systems 452 and positioning the gliding boards into a snowboard configuration position 454. In cases using a structural and semi-circular jacket, the method 450 involves positioning the jacket 456 over the tips and tails of the gliding boards. Next, the method involves coupling the tip connector and tail connector 458, and coupling the ski connection clip pairings 460. Finally, the method 450 involves attaching the bindings to ski binding plate systems 462.

As explained above, some embodiments of the present technology involve binding plate systems that are reconfigurable and are configured such that the binding system separates in the event of a threshold level of torque being applied, thereby causing the skier's/rider's feet to come free from the board(s) in dangerous circumstances.

Figure 5:
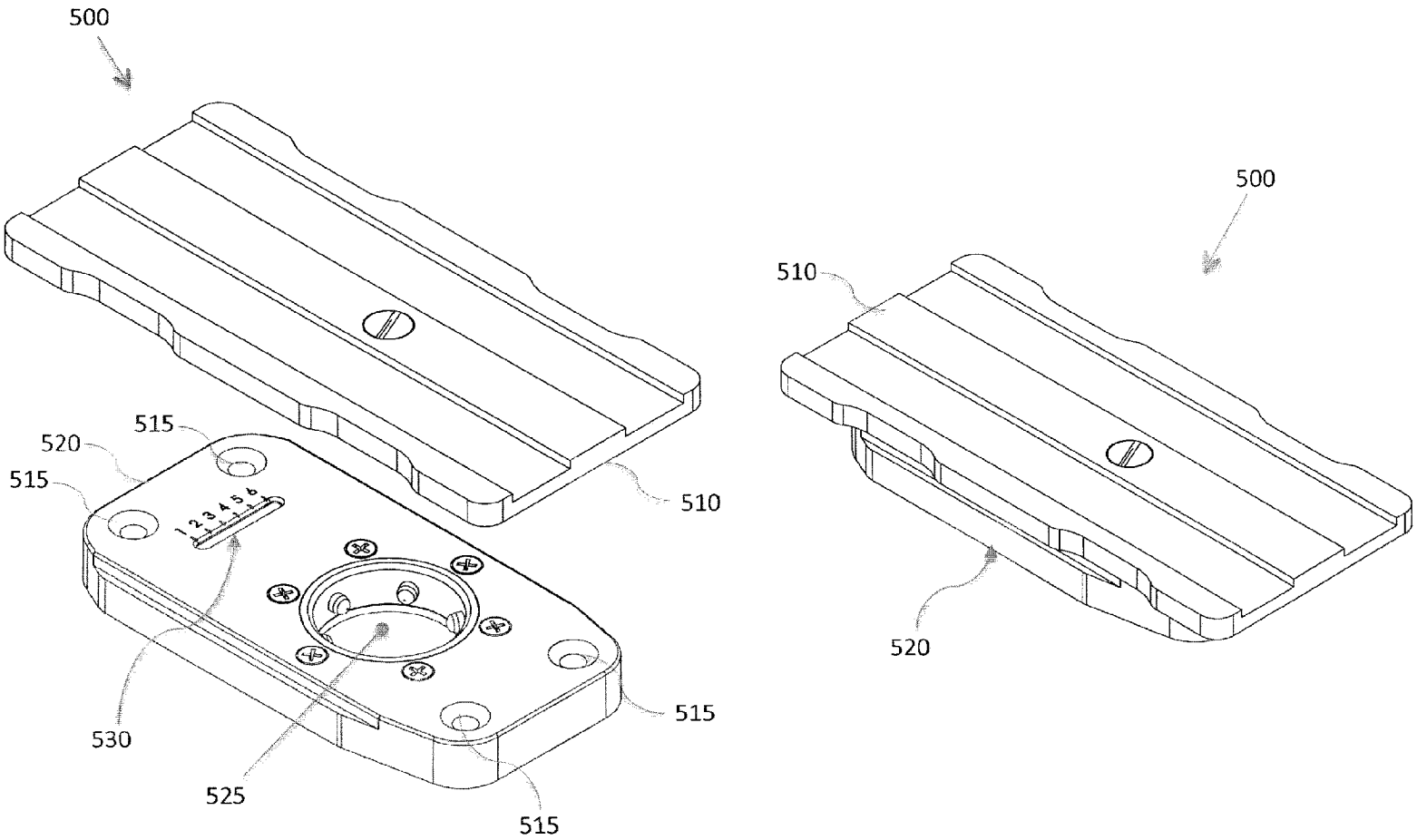
FIG. 5 illustrates two isometric views of a plate binding system according to some embodiments of the present technology.

FIG. 5 illustrates two isometric views of a plate binding system 500 according to some embodiments of the present technology. The plate binding system 500 comprises a top plate 510 with a disk (not shown) extending from its bottom surface and bottom plate 520 having a disk-receiving aperture 525. The top plate 510 is configured to slide into the slider tracks 210 of the bindings 200 shown in FIG. 2 above, thereby coupling the binding 200 to the plate system 500. The bottom plate 520 comprises drill holes 515 for attaching the plate binding system 500 to the gliding boards.

The disk (not shown) extending from the bottom surface of the top plate 510 is releasably coupled inside the aperture 525 of the bottom plate 520 via a plurality of pins 353. The bottom plate 520 also includes a release-setting gauge 530 that displays a setting for the currently selected torque threshold required to separate the disk from the aperture 525. The bottom plate 520 also includes a set screw (shown in FIG. 6 below) for adjusting the sensitivity of the release settings.

Figure 6:
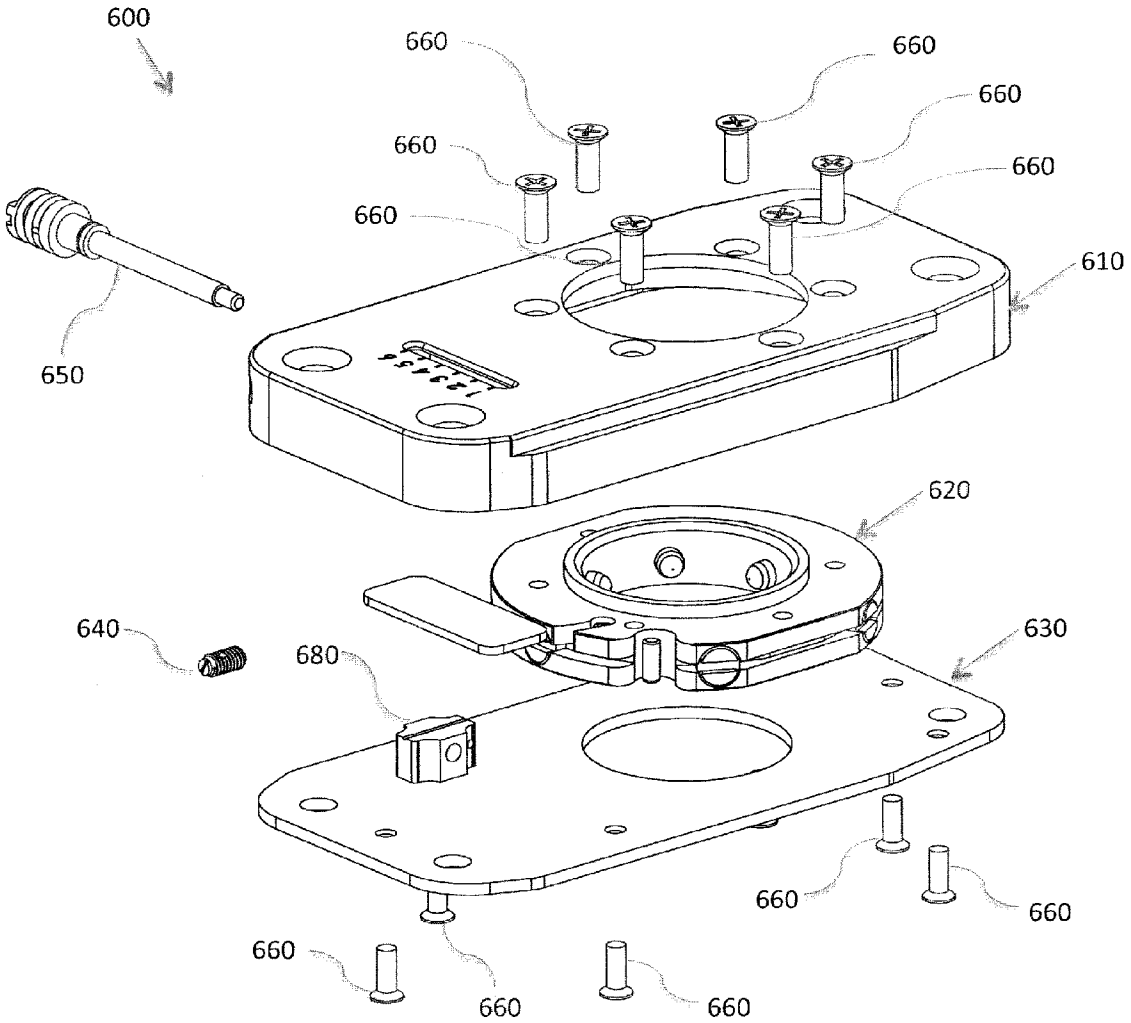
FIG. 6 illustrates an exploded view of a bottom plate of a plate binding system according to some embodiments of the present technology.

FIG. 6 illustrates an exploded view of a bottom plate 600 of a plate binding system according to some embodiments of the present technology. As shown, the bottom plate 600 comprises a torque-sensitive release mechanism 620 housed within a cavity created by space between cover 610 and cover 630. The torque-sensitive release mechanism 620 is sealed in the cavity via a plurality of pins 660 and screws 670. Also housed in the cavity are a settings piston 650 and a piston guide 680. The settings piston 650 is coupled with and a set screw 640 that is manipulated from outside the cavity. Also, the settings piston 650 is configured to adjust the torque sensitivity settings for the torque-sensitive mechanism 620 upon rotation of the set screw 640.

The various embodiments described above are provided by way of illustration only and should not be construed to limit the scope of the disclosure. Those skilled in the art will readily recognize various modifications and changes that may be made to the principles described herein without following the example embodiments and applications illustrated and described herein, and without departing from the spirit and scope of the disclosure.

The invention claimed is:

1. A ski-snowboard combination device comprising:

a first gliding board having an first edge having a substantially concave shape;

a second gliding board having a first edge having a substantially concave shape;

a binding mounting system mounted on the first gliding board and the second gliding board, the binding mounting system having:

a top plate; and a bottom plate with a torque-sensitive release mechanism and a release-setting gauge, wherein the binding mounting system is releasable upon in the event of a threshold level of torque applied to the torque-sensitive release mechanism; and a fastening device comprising a first part and a second part, the first part mounted on the first gliding board and the second part mounted on the second gliding board, the fastening device being configured to reversibly affix the inside edge of the first gliding board to the inside edge of the second gliding board, wherein when the inside edge of the first gliding board and the inside edge of the second gliding board form an opening with two convex sides, wherein the binding mounting system is reconfigurable between a ski binding mounting system and a snowboard binding mounting system.

2. The ski-snowboard combination device of claim 1, wherein the binding mounting system further comprising:

a first ski binding system coupled with the first gliding board;

a second ski binding system coupled with the second gliding board; and a snowboard binding system coupled with the first gliding board and the second gliding board.

3. The ski-snowboard combination device of claim 1, the first gliding board further having a second edge having a substantially concave shape, and the second gliding board further having a second edge having a substantially concave shape.

4. The ski-snowboard combination device of claim 1, wherein both the first gliding board central zone and the second gliding board central zone have a substantially flat bottom surface and comprise a substantially axial member having a first terminal end and a second terminal end separated by a binding mounting area on their top surface.

5. The ski-snowboard combination device of claim 1, wherein the binding mounting system further comprising:

a first ski binding mounting system coupled to the mounting area of the first gliding board and configured to affix a ski binding thereto in a position facing the first terminal end of the first gliding board;

a second ski binding mounting system coupled to the mounting area of the second gliding board and configured to affix a ski binding thereto in a position facing the first terminal end of the second gliding board;

a first one-half of a front foot snowboard binding mounting system coupled to the mounting area of the first gliding board;

a second one-half of a front foot snowboard binding mounting system coupled to the mounting area of the second gliding board;

a first one-half of a back foot snowboard binding mounting system coupled to the mounting area of the first gliding board; and a second one-half of a back foot snowboard binding mounting system coupled to the mounting area of the second gliding board, wherein the first one-half of the front foot snowboard binding mounting system and the second one-half of the front foot snowboard mounting system are configured to affix a first snowboard binding to the first gliding board and the second gliding board in a direction substantially perpendicular to the axial length of the first gliding board and second gliding board, and wherein the first one-half of the back foot snowboard binding mounting system and the second one-half of the back foot snowboard mounting system are configured to affix a second snowboard binding to the first gliding board and the second gliding board in a direction substantially perpendicular to the axial length of the first gliding board and second gliding board.

6. The ski-snowboard combination device of claim 5, each of the first ski binding mounting system and the second ski binding mounting system further comprises:

a bottom plate having a disk-accepting aperture disposed therein, the bottom plate being configured to be non-releasably coupled with a gliding board; and a top plate having a disk disposed on the bottom-side surface of the top plate and a top-side surface configured to be non-releasably coupled with a boot, wherein the disk is configured to be releasably aligned with the disk-accepting aperture of the bottom plate in the event of the threshold level of torque applied to the disk.

7. The ski-snowboard combination device of claim 1 wherein the bottom plate further comprises:

a set screw accessible from the outside of the bottom plate in mechanical communication with the torque-sensitive release mechanism and configured for adjusting the threshold torque, wherein the torque-sensitive release mechanism housed within the bottom plate and aligned with the disk-accepting aperture to interact with the torque-sensitive release mechanism.

8. The ski-snowboard combination device of claim 4, further comprising:

a tip clip coupled to the first terminal end of the first gliding board;

a tip peg coupled with the first terminal end of the second gliding board;

a tail clip coupled to the second terminal end of the first gliding board; and a tail peg coupled with the second terminal end of the second gliding board, wherein the tip clip is configured to latch onto the tip peg and the tail clip is configured to latch onto the tail peg, thereby further reversibly affixing the inside edge of the first gliding board to the inside edge of the second gliding board.

9. The ski-snowboard combination device of claim 4, further comprising:

a jacket configured to fit over a portion of the first terminal end of the first gliding board and the first terminal end of the second gliding board when the fastening device reversibly affixes the inside edge of the first gliding board to the inside edge of the second gliding board.

10. A ski-snowboard combination device comprising:

a first gliding board having an outer edge configured for use as a snowboard and having an inner edge configured for use as a downhill ski;

a second gliding board being a reciprocal mirror image shape from the first gliding board such that the second gliding board also has an outer edge configured for use as a snowboard and having an inner edge configured for use as a downhill ski;

a binding mounting system mounted on the first gliding board and the second gliding board, the binding mounting system having:

a top plate; and a bottom plate with a torque-sensitive release mechanism and a release-setting gauge, wherein the binding mounting system is releasable upon in the event of a threshold level of torque applied to the torque-sensitive release mechanism; and a fastening device configured to affix the first gliding board to the second gliding board, whereby the inner edge of the first gliding board is pressed against the inner edge of the second gliding board, wherein the binding mounting system is reconfigurable between a ski binding mounting system and a snowboard binding mounting system.

11. The ski-snowboard combination device of claim 10, wherein when the inner edge of the first gliding board and the inner edge of the second gliding board forms an opening with two convex sides when the fastening device affixes the first gliding board to the second gliding board.

12. The ski-snowboard combination device of claim 10, wherein both the first gliding board and the second gliding board have a substantially flat bottom surface and comprise a substantially axial member having a first terminal end and a second terminal end separated by a binding mounting area on their top surface.

13. The ski-snowboard combination device of claim 10, wherein the binding mounting system further comprising:

a first ski binding mounting system coupled to the mounting area of the first gliding board and configured to affix a ski binding thereto in a position facing the first terminal end of the first gliding board;

a second ski binding mounting system coupled to the mounting area of the second gliding board and configured to affix a ski binding thereto in a position facing the first terminal end of the second gliding board;

a first one-half of a front foot snowboard binding mounting system coupled to the mounting area of the first gliding board;

a second one-half of a front foot snowboard binding mounting system coupled to the mounting area of the second gliding board;

a first one-half of a back foot snowboard binding mounting system coupled to the mounting area of the first gliding board; and a second one-half of a back foot snowboard binding mounting system coupled to the mounting area of the second gliding board, wherein the first one-half of the front foot snowboard binding mounting system and the second one-half of the front foot snowboard mounting system are configured to affix a first snowboard binding to the first gliding board and the second gliding board in a direction substantially perpendicular to the axial length of the first gliding board and second gliding board, and wherein the first one-half of the back foot snowboard binding mounting system and the second one-half of the back foot snowboard mounting system are configured to affix a second snowboard binding to the first gliding board and the second gliding board in a direction substantially perpendicular to the axial length of the first gliding board and second gliding board.

14. The ski-snowboard combination device of claim 13, each of the first ski binding mounting system and the second ski binding mounting system further comprises:

a bottom plate having a disk-accepting aperture disposed therein, the bottom plate being configured to be non-releasably coupled with a gliding board; and a top plate having a disk disposed on the bottom-side surface of the top plate and a top-side surface configured to be non-releasably coupled with a boot, wherein the disk is configured to be releasably aligned with the disk-accepting aperture of the bottom plate in the event of the threshold level of torque applied to the disk.

15. The ski-snowboard combination device of claim 10, wherein the bottom plate further comprises:

a set screw accessible from the outside of the bottom plate in mechanical communication with the torque-sensitive release mechanism and configured for adjusting the threshold torque, wherein the torque-sensitive release mechanism housed within the bottom plate and aligned with the disk-accepting aperture to interact with the torque-sensitive release mechanism.

16. The ski-snowboard combination device of claim 12, further comprising:

a tip clip coupled to the first terminal end of the first gliding board;

a tip peg coupled with the first terminal end of the second gliding board;

a tail clip coupled to the second terminal end of the first gliding board; and a tail peg coupled with the second terminal end of the second gliding board, wherein the tip clip is configured to latch onto the tip peg and the tail clip is configured to latch onto the tail peg, thereby further reversibly affixing the inner edge of the first gliding board to the inner edge of the second gliding board.

17. The ski-snowboard combination device of claim 12, further comprising:

a first jacket configured to fit over a portion of the first terminal end of the first gliding board and the first terminal end of the second gliding board when the fastening device reversibly affixes the inner edge of the first gliding board to the inner edge of the second gliding board; and a second jacket configured to fit over a portion of the second terminal end of the first gliding board and the second terminal end of the second gliding board when the fastening device further reversibly affixes the inner edge of the first gliding board to the inner edge of the second gliding board.

18. A ski-snowboard combination device comprising:

a first gliding board having a first ski binding mounting system mounted on the first gliding board;

a second gliding board having a second ski binding mounting system mounted on the second gliding board;

a fastening device comprising a first part and a second part, the first part mounted on the first gliding board and the second part mounted on the second gliding board, the fastening device being configured to reversibly affix the inside edge of the first gliding board to the inside edge of the second gliding board, wherein when the inside edge of the first gliding board and the inside edge of the second gliding board form an opening with two convex sides;

a bottom plate being configured to be non-releasably coupled with each of the gliding board, the bottom plate having:

a torque-sensitive release mechanism; and a release-setting gauge, wherein the bottom plate is aligned with a disk-accepting aperture disposed therein; and a top plate having a disk disposed on a bottom-side surface of the top plate and a top-side surface configured to be non-releasably coupled with a boot, wherein the disk is configured to be releasably aligned with the disk-accepting aperture of the bottom plate in the event of a threshold level applied to the disk.

19. The ski-snowboard combination device of claim 1, wherein the release setting gauge is configured for displaying a quantified representation of the threshold torque and visible from the outside of the bottom plate.

20. The ski-snowboard combination device of claim 10, wherein the release setting gauge is configured for displaying a quantified representation of the threshold torque and visible from the outside of the bottom plate.

* * * * *

UNITED STATES PATENT AND TRADEMARK OFFICE

CERTIFICATE OF CORRECTION

PATENT NO. : 8,708,371 B2
APPLICATION NO. : 13/751007
DATED : April 29, 2014
INVENTOR(S) : Richard Bulan It is certified that error appears in the above-identified patent and that said Letters Patent is hereby corrected as shown below:

On the Title Page
Item 12, please change “Balun” to “Bulan”
Item 72, please change “Richard Balun” to “Richard Bulan”

In the Specification
In Column 1, line 8, please change “Alpine Split Board” to “Alpine Splitboard”

Signed and Sealed this
Twelfth Day of August, 2014

Michelle K. Lee

Michelle K. Lee
*Deputy Director of the United States Patent and Trademark Office*